US011320141B1

(12) United States Patent
Puckett

(10) Patent No.: US 11,320,141 B1
(45) Date of Patent: May 3, 2022

(54) HYBRID LIGHT AND FAN FIXTURE

(71) Applicant: Michael Puckett, Mt. Carmel, TN (US)

(72) Inventor: Michael Puckett, Mt. Carmel, TN (US)

( * ) Notice: Subject to any disclaimer, the term of this patent is extended or adjusted under 35 U.S.C. 154(b) by 0 days.

(21) Appl. No.: 17/369,309

(22) Filed: Jul. 7, 2021

Related U.S. Application Data

(63) Continuation-in-part of application No. 16/938,908, filed on Jul. 24, 2020.

(51) Int. Cl.

| | |
|---|---|
| ***F21V 33/00*** | (2006.01) |
| ***F21V 23/06*** | (2006.01) |
| ***F04D 25/06*** | (2006.01) |
| ***F24H 3/04*** | (2022.01) |
| ***H05B 3/84*** | (2006.01) |
| *F21Y 115/10* | (2016.01) |

(52) U.S. Cl.
CPC ..... *F21V 33/0096* (2013.01); *F04D 25/06* (2013.01); *F21V 23/06* (2013.01); *F24H 3/04* (2013.01); *H05B 3/84* (2013.01); *F21Y 2115/10* (2016.08); *H05B 2203/003* (2013.01)

(58) Field of Classification Search
CPC ..... F21V 33/0096; F21V 23/06; F04D 25/06; F24H 3/04; H05B 3/84; H05B 2203/003; F21Y 2115/10; F24F 13/078; F24F 7/06
See application file for complete search history.

(56) References Cited

U.S. PATENT DOCUMENTS

| | | | | |
|---|---|---|---|---|
| 4,816,973 | A * | 3/1989 | Atalla | F21S 8/035 362/101 |
| 5,467,423 | A | 11/1995 | Jakubowski | |
| 7,267,462 | B2 | 9/2007 | Cronin | |
| 10,225,887 | B1 | 3/2019 | Winters | |
| 10,317,065 | B2 | 6/2019 | Holmes et al. | |
| 11,104,451 | B2 | 8/2021 | Phifer | |
| 11,112,065 | B2 | 9/2021 | Ramaiah et al. | |
| 2014/0254135 | A1* | 9/2014 | Nolan | F24F 13/078 362/92 |
| 2017/0223775 | A1* | 8/2017 | Scanlon | H05B 3/16 |
| 2018/0045204 | A1* | 2/2018 | Van Grootheest | F04D 25/088 |

FOREIGN PATENT DOCUMENTS

| | | |
|---|---|---|
| WO | 2021049766 | 3/2021 |

* cited by examiner

*Primary Examiner* — Bao Q Truong
(74) *Attorney, Agent, or Firm* — Richard K Thomson

(57) ABSTRACT

A hybrid light and fan fixture includes a plurality of LED lights surrounding a fan and its motor within a housing. A connector is made to allow the hybrid fixture to be installed in a conventional light socket for 110v electrical power. An alternative embodiment includes either or both features of a set or rotatable deflector blades and a serpentine heating element to more positively influence the air flow created by the fan and make the air stream more effective in de-fogging the mirror. Preferably, the fixture includes a circuit that allows the lights to be energized with and without the fan and heating element.

3 Claims, 5 Drawing Sheets

HYBRID LIGHT AND FAN FIXTURE

This application is a continuation-in-part of U.S. patent application Ser. No. 16/938,908 filed Jul. 14, 2020, which is hereby incorporated by reference in its entirety.

BACKGROUND AND SUMMARY OF THE INVENTION

The present invention is directed to the field of bathroom light fixtures. More particularly, the present invention is directed to an LED light fixture including a mirror de-fogging fan.

In the normal course of taking a shower, regardless of whether or not the ceiling fan is making a ruckus, the bathroom mirror inevitably fogs over. This can be annoying for any number of reasons; among them are 1) upon emerging from the shower, the shower-taker is unable to bask in the reflected vision of her/his freshly cleansed body and 2) she/he is totally unable to see her/his significant other approaching from behind with the intent of administering a "wet-willy". It may be possible to avoid this latter development by careful screening of shower partners. However, some candidates will intentionally mask these dastardly tendencies until after the "for-better-or worse" vows have been exchanged, at which point the "wet-willy wildness" simply lapses into the "or worse" category of tough luck.

It is among the objects of the present invention to provide a hybrid light and fan fixture that can screw into a conventional socket adjacent the mirror to prevent the steaming up of the mirror surface that normally takes place. Typically, a plurality of 3-6 such fixtures will be positioned along the side or top of the mirror, depending on the location the light bar is mounted and the size of the mirror being fanned. A second embodiment can feature a heating element to accelerate the mirror de-fogging and/or an adjustable deflector to more fully direct the air flow from the fan toward the mirror's surface.

The present invention comprises a hybrid light and fan fixture including a) a plurality of LED lights; b) a motor for rotating a shaft; c) a fan blade secured to the shaft to be rotated by the motor; d) a housing surrounding the LED lights, the motor and the fan blade; e) a connector extending through an upper portion of the housing for insertion in an electric light socket; e) circuitry connected between the connector and i) the LED lights and ii) the motor to power the LED lights and the fan motor. In a second embodiment, additional features in the form of an air-directing set of vanes and/or a heating element can be provided to accentuate the ability of the fan to achieve its de-fogging objective. Preferably, the circuitry include a dual function circuit, a first which energizes the plurality of LED lights and a second which energizes the fan motor and the heating element, if provided.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
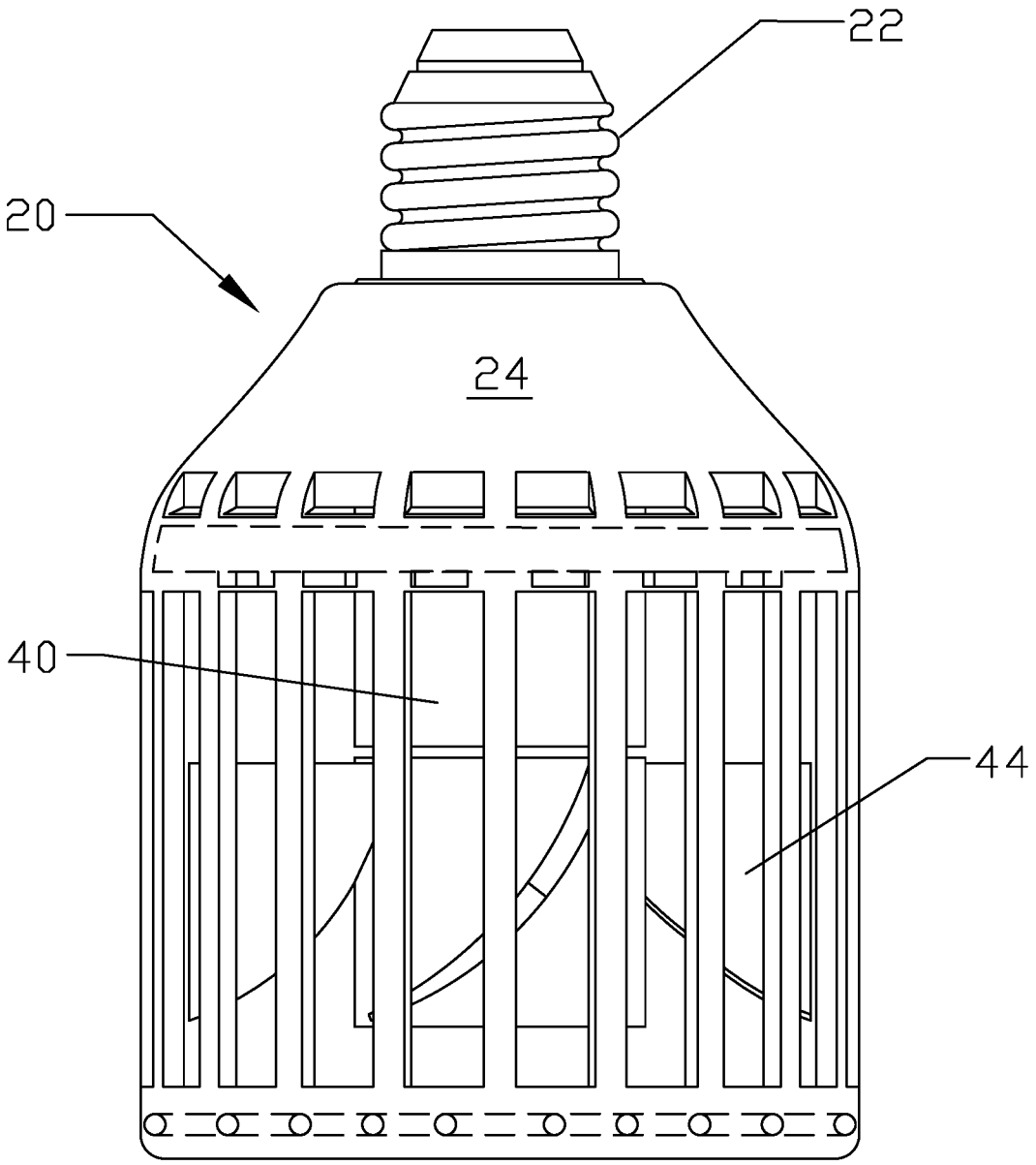
FIG. 1 is a side view of the first embodiment of the hybrid light and fan fixture of the present invention.
Figure 2:
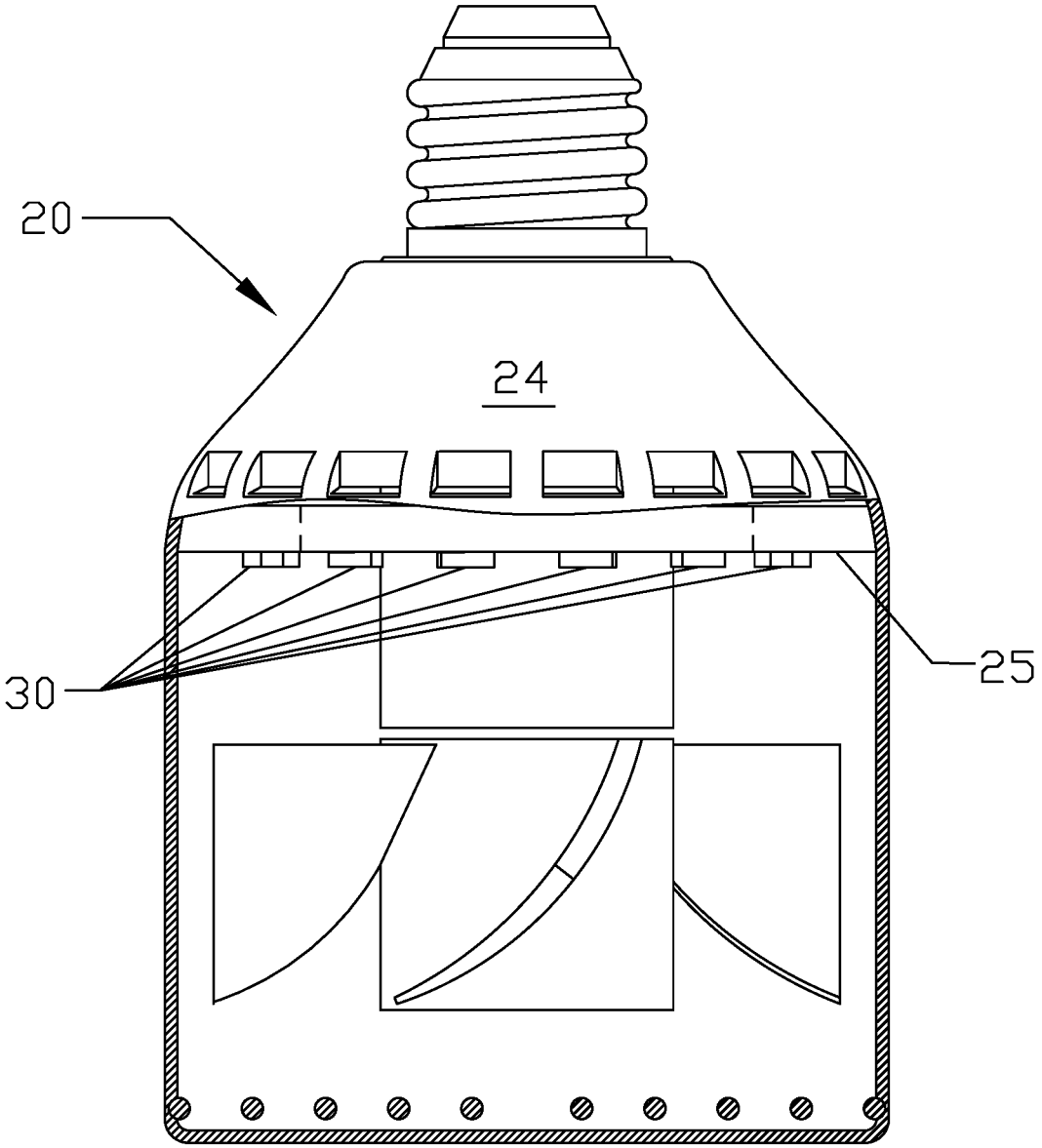
FIG. 2 is a side view of the first embodiment with parts broken away.
Figure 3:
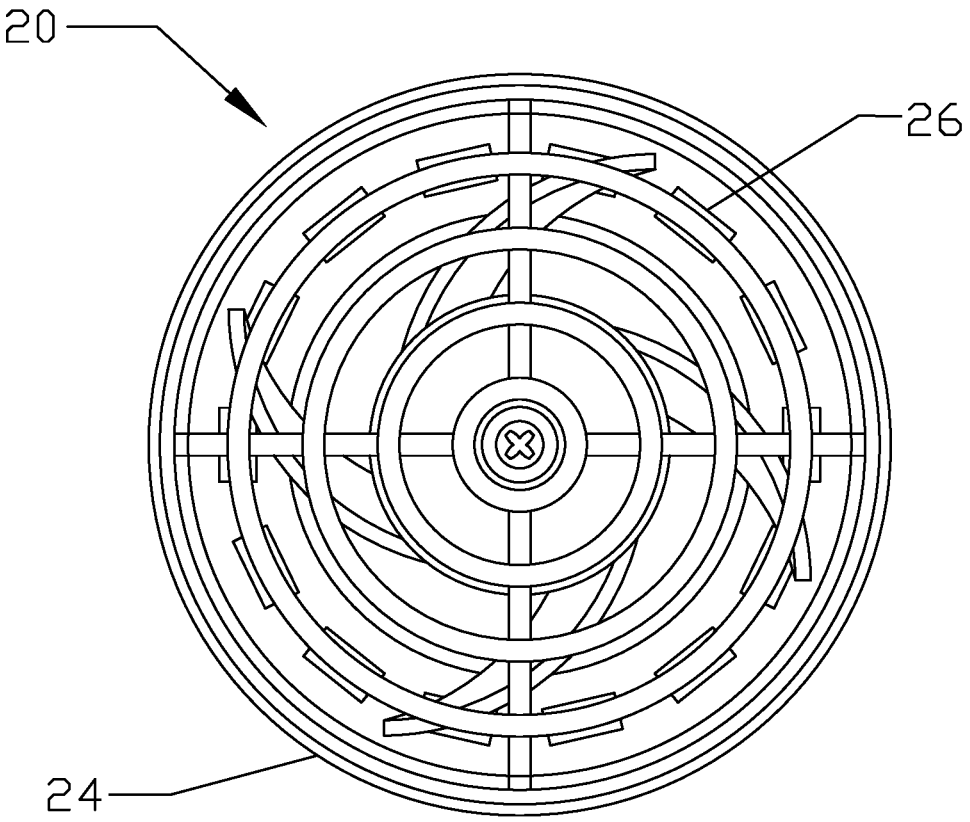
FIG. 3 is bottom view of the first embodiment.
Figure 4:
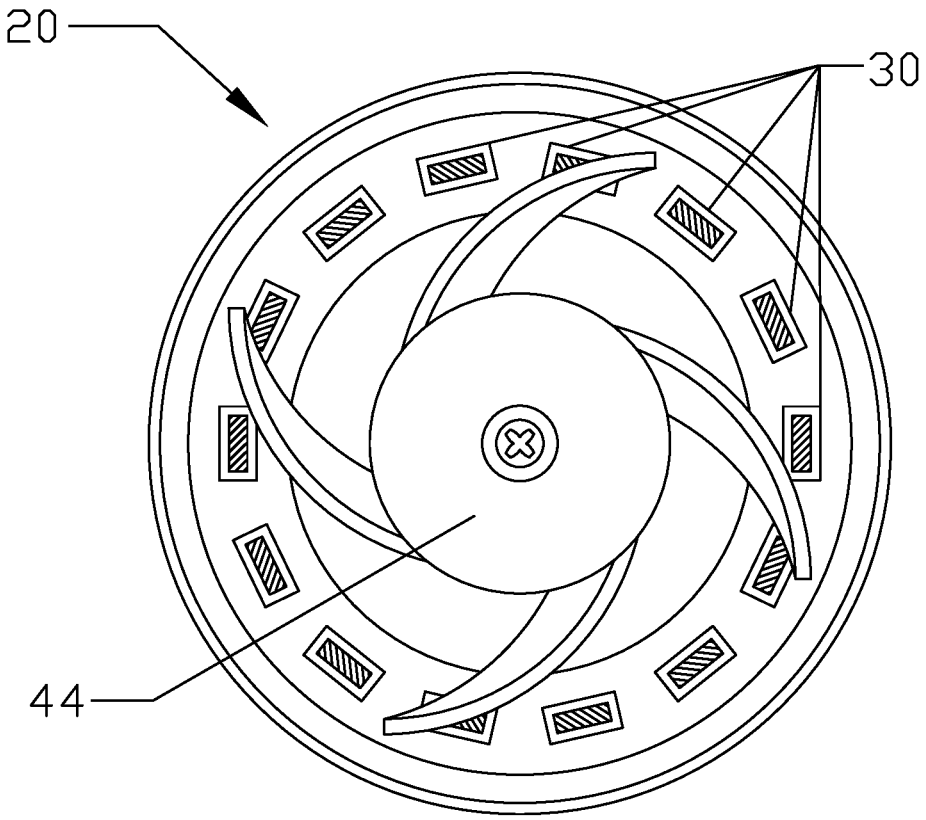
FIG. 4 is a bottom view with parts broken away of the first embodiment.

A first embodiment of the hybrid light and fan of the present invention is depicted in FIGS. 1-4 generally at 20. Hybrid light and fan fixture 20 is shown with a conventional connector 22 for a 1" 110v light socket. The hybrid light and fan fixture 20 of the present invention could be fashioned with a smaller connector to attach in boutique light bars without departing from the scope of the invention. Housing 24 surrounds the periphery of the hybrid light and fan fixture and is preferably made of durable, high-strength plastic with metal grate 26 (FIG. 3) secured across the bottom of housing 24.

Within the housing 24 around the periphery of the top 25 is a series of LED's 30 (typically 12-16) which illuminate the room in which the fixture operates. Motor 40 extends through the series of LED's 30 and has a shaft 42 protruding from the lower end. Shaft 42 mounts a 4-bladed fan 44 secured thereto in order to be rotated by motor 40. Fan 44 may be made of metal but is preferably made of plastic to avoid corrosion from the moisture produced in the steamy bathroom environment. The socket into which connector 22 is mounted provides electrical power to energize both the LED's 30 and the fan motor 40. It is among the features of the present invention that the fixture 20 includes a dual operating circuit: a first flick of the wall switch will illuminate the lights, a second flick of the switch within a one second time period of the first, will cause the fan to be added to the lights.

Figure 5:
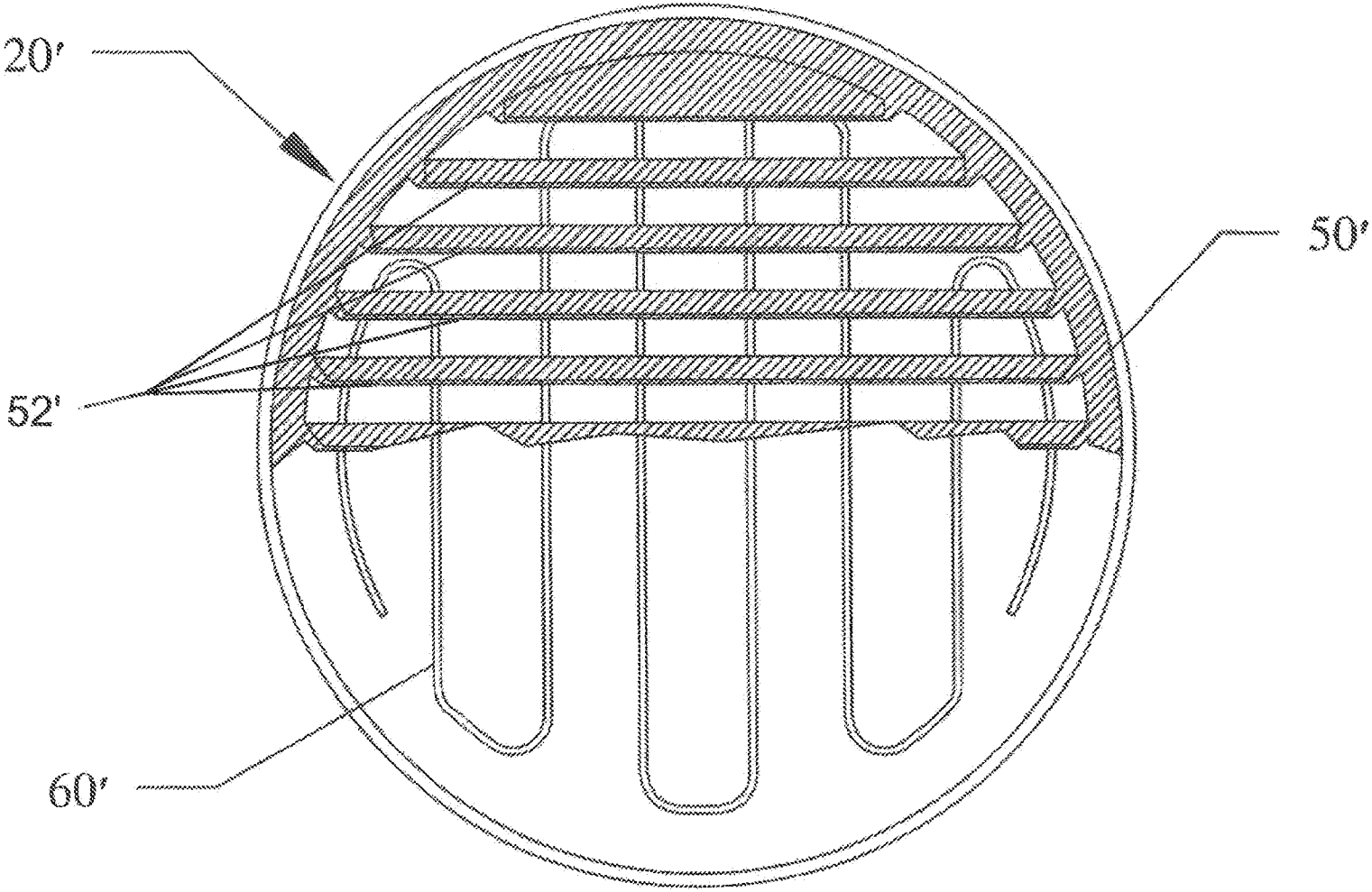
FIG. 5 is a bottom view with parts broken away of the second embodiment.

A second embodiment of the hybrid light and fan of the present invention is shown in FIG. 5 generally at 20'. In addition to the lights and fan afforded in the first embodiment, this second embodiment can provide a set of deflector vanes 52' mounted on a rotatable ring 50' which allows the air stream to be focused more effectively directly at the mirror surface and a serpentine heating element 60' typically installed below the layer of LED lights. It will be appreciated that these additional features may be provided individually, i.e., separately, or together.

While the hybrid light and fan fixture 20 has been designed, and is particularly suited for, preventing a bathroom mirror from fogging, it is obviously suitable for other uses such as clearing smoke from a kitchen or smoking room, providing cooling flow on a sun porch or in other rooms; any number of applications could benefit from the device of the present invention.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A hybrid light and fan fixture for use in de-fogging a bathroom mirror, said fixture comprising:

a) a plastic housing having a generally circular configuration;

b) a series of 12-16 LED lights positioned about the periphery of and inside said plastic housing;

c) a motor extending through the middle of said series of 12-16 LED lights, said motor having a shaft extending from a bottom portion thereof;

d) a fan blade connected to said shaft for being rotated by said motor;

e) a connector extending through an upper portion of said housing for insertion in an electric light socket;

f) circuitry connected between said connector and said LED lights and said motor to power said LED lights and said fan motor, whereby a first flick of a wall switch illumines said series of 12-16 LED lights and a second flick of the light switch activates said motor to rotate said fan blade.

2. The hybrid light and fan fixture of claim 1 further comprising a set of deflector vanes mounted on a rotatable ring which can turn relative to said hybrid light and fan fixture to focus an air stream produced by said fan more directly as desired.

3. The hybrid light and fan fixture of claim 1 further comprising a serpentine heating element for heating an air stream produced by said fan.

* * * * *